US012490824B1

(12) United States Patent
Lloyd

(10) Patent No.: US 12,490,824 B1
(45) Date of Patent: Dec. 9, 2025

(54) SALON CAPE WITH MAGNETIC CLOSURES AND METHOD

(71) Applicant: Shayna Lloyd, Frisco, TX (US)

(72) Inventor: Shayna Lloyd, Frisco, TX (US)

( * ) Notice: Subject to any disclaimer, the term of this patent is extended or adjusted under 35 U.S.C. 154(b) by 0 days.

(21) Appl. No.: 19/184,711

(22) Filed: Apr. 21, 2025

(51) Int. Cl.
*A45D 44/08* (2006.01)
*A41B 13/10* (2006.01)

(52) U.S. Cl.
CPC ..... *A45D 44/08* (2013.01)

(58) Field of Classification Search
CPC ..... A45D 44/08
See application file for complete search history.

(56) References Cited

U.S. PATENT DOCUMENTS 3,827,019 A * 7/1974 Serbu ..... A41F 1/002 135/117
4,650,002 A * 3/1987 Pierce, Jr. ..... A62C 8/06 169/65
6,412,116 B1 * 7/2002 Clark ..... A45D 44/08 2/129
6,571,395 B1 * 6/2003 Korkor ..... A41D 13/1245 2/45
7,269,855 B2 * 9/2007 LaRocco ..... A41B 13/103 2/49.1
8,353,064 B2 * 1/2013 Tagatz ..... A45D 44/08 2/50
9,468,242 B1 * 10/2016 Lee ..... A41D 13/04
10,051,899 B2 * 8/2018 Campbell ..... A41D 13/04
10,986,882 B2 * 4/2021 Johnson ..... A41D 1/22
2010/0275928 A1 * 11/2010 Roberts ..... A41D 13/1236 128/849
2010/0306895 A1 * 12/2010 Tagatz ..... A45D 44/08 2/50
2014/0201881 A1 * 7/2014 Musto ..... A45D 44/08 2/46
2015/0374102 A1 * 12/2015 Velasquez, Jr. ..... A45D 44/08 2/50
2017/0049165 A1 * 2/2017 Turley ..... A44C 5/2033
2017/0172286 A1 * 6/2017 Matsuda ..... A45D 44/08
2019/0142140 A1 * 5/2019 Bacon ..... A45D 44/08 2/50
2019/0183690 A1 * 6/2019 Nhan ..... A61L 15/225

* cited by examiner

*Primary Examiner* — Robert H Muromoto, Jr.
(74) *Attorney, Agent, or Firm* — Braxton Perrone, PLLC; Gregory Perrone; Bobby W. Braxton

(57) ABSTRACT

A protective magnetized cape for secure placement on a wearer having a left shoulder flap and an elongated right shoulder flap and a plurality of magnet pairs for securing the left shoulder flap to the right shoulder flap at the back of the wearer and the right shoulder tlap to the chest area of the wearer.

12 Claims, 4 Drawing Sheets

SALON CAPE WITH MAGNETIC CLOSURES AND METHOD

TECHNICAL FIELD

This disclosure relates to salon products and in particular for a salon stylist's cape having magnetic closures.

The presently described stylist cape is used by hair stylists, cosmetologists or other like professionals where a customer seeking such professional services is to wear a protective over-garment to protect the customer's clothing while receiving services. Generally, capes used by customers of hair stylists, cosmetologists and the like are well known. Typically, such capes include various means of less than effective closure mechanisms. Some capes include a pair of strings or ribbon-like extensions from an edge of the body of the cape that facilitates tying the opening of the cape that surrounds the subject's neck. The problem with such a cape is that it can provide an uncomfortable fit for the wearer and the strings or ribbons over time may break away from the cape, rendering the cape useless.

Another fastening means includes hook and loop material to secure the cape about the user's neck. This also results in an uncomfortable fit as the fastener must be tightly placed around the person's neck in order for the cape to have the level of closure needed to provide the necessary protection. Another drawback is that book and loop material attracts unwanted matter such as hair, lint or other debris. Once the hook and loop material becomes full of the unwanted matter, the hook and loop material becomes less and less securable until it becomes ineffective in securing the cape around the user's neck area, again rendering the cape useless. The other issue with strings or hook and loop material is that they are usually placed only at the neck area of the cape and the body is not adequately closed, rending the cape less than effective in protecting the wearer's clothing. Snaps and buttons are also equally ineffective as over time they become dislodged from the cape material and take considerable time to secure all of the snaps placed throughout the cape. Similarly, magnetized collars tend to have the same drawbacks as strings or hook and loop material in terms of discomfort as the collar's pressure point is around the neck of the wearer. In addition, traditional capes are not easily applied to the wearer in a way that encloses the chair occupied by the user. This causes traditional capes to hang freely, often getting in the stylist's way, causing a tripping hazard, and providing less than ideal protection of the wearer's garments. What is needed is a cape having fasteners that are not susceptible to damage, rendering the cape useless while at the same time providing effective coverage of the wearer's clothing and comfort for the wearer.

SUMMARY

According to the present disclosure, a cape is disclosed having a cape body with a left shoulder flap and a right shoulder extended flap, and a collar opening, with a first magnet disposed diagonally downward in relation to an outer edge of the left shoulder flap, a second magnet disposed at the exterior side edge 103 of cape body 102, a third magnet disposed diagonally downward in relation to the collar opening, and a fourth magnet disposed on the right shoulder extended flap proximate to the collar opening edge.

In operation, the wearer of the cape typically sitting in a chair, receives the cape with the wearers head and neck at the approximate center of the neck opening. The left shoulder flap is wrapped around the left shoulder of the wearer from front to back. The right shoulder extended flap is wrapped around the right shoulder of the wearer from front to back. The first magnet is paired with the second magnet at approximately the center of the wearer's back, with the first magnet and second magnet in a substantially horizontal position when paired. When paired, the left shoulder flap is beneath the right extended shoulder flap. Next the right extended shoulder flap is wrapped around the wearer's left shoulder from back to front, with the right extended shoulder flap draped downward across the front of the wearer from the shoulder to the chest area. The third magnet is paired with the fourth magnet, with both magnets in substantially a downward angled position when paired.

Once the cape is wrapped and the magnets secured, the wearer is comfortably covered with the cape. If the wearer is sitting in a chair, the chair is optionally encompassed by the cape. In a stylist setting, the cape and accompanying magnets provide a compact and effective protection means.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

In the following detailed description of exemplary embodiments of the invention, specific exemplary embodiments in which the invention may be practiced are described in sufficient detail to enable those skilled in the art to practice the invention, and it is to be understood that other embodiments may be utilized and that architectural, mechanical, electrical and other changes may be made without departing from the spirit or scope of the present invention. The following detailed description is, therefore, not to be taken in a limiting sense, and the scope of the present invention is defined only by the appended claims and their equivalents.

Figure 1:
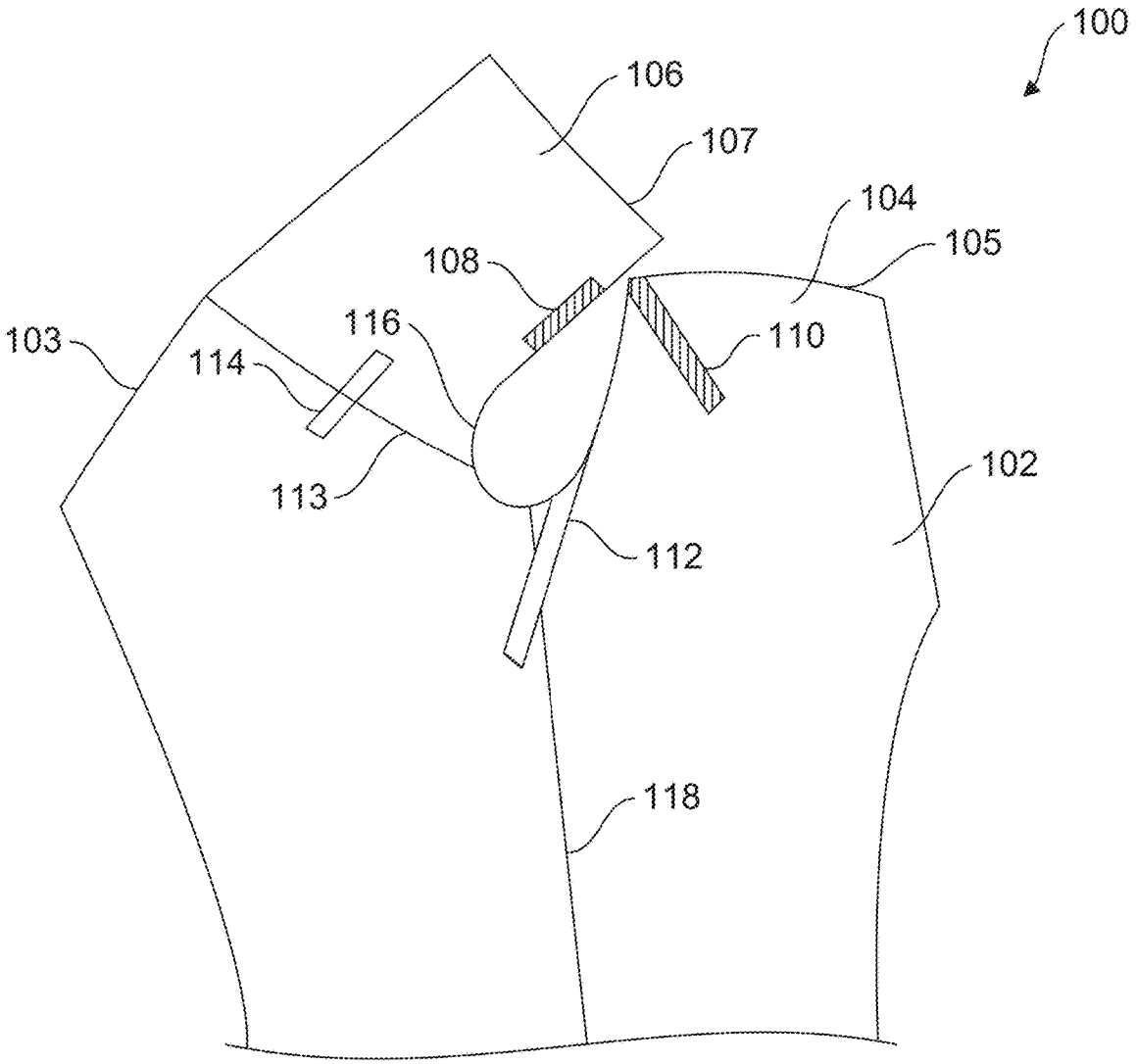
FIG. 1 depicts a front view of a magnetized cape according to an embodiment.

FIG. 1 depicts a front view of a magnetized cape according to an embodiment. In FIG. 1, cape 100 comprises a cape body 102 that operates as a cover to protect the clothing and skin of a wearer. Cape 100 is typically used in a stylist setting by hair stylists, cosmetologists, and may also be used in various medical settings where the procedure is such that the wearer's clothing and/or skin needs protection. Cape 100 includes collar opening 116 that extends around the next and collarbone area of the wearer. Cape 100 further comprises left shoulder region 104 and right extended shoulder region 106. Left shoulder region 104 and right extended shoulder region 106 are the means by which the cape is wrapped around the user and effectively fastened via the plurality of placed magnets as will be described. Left shoulder region 104 is bordered by left shoulder edge 105 and right extended shoulder region 106 is bordered by right shoulder edge. Right extended shoulder flap 106 is longer than left shoulder flap 104 in an embodiment as right extended shoulder flap 106 is the side of cape 100 that is wrapped almost completely around the wearer and securing left should flap 104 beneath it. Centerline 118 is disposed at the approximate center of cape body 102 and in an embodiment is represented by a connection zone where a left side of cape body 102 and a right side of cape body 102 are sewn or otherwise connected.

Continuing with FIG. 1, four magnets are disposed at various points on cape 100 to provide effective fastening of the cape around the wearer. As shown, a first magnet 110 is disposed diagonally downward in relation to left shoulder edge 105 of left shoulder flap 104. A second magnet 114 is disposed proximate to the exterior side edge 103 of cape body 102 and across back seam 113. A third magnet 112 is disposed diagonally downward in relation to collar opening 116 towards the bottom section of cape 100. A fourth magnet 108 is disposed on right shoulder extended flap 106 at the edge of collar opening 116.

The four magnets as described are installed within or on cape 100 in various ways. In one embodiment, the magnets are embedded in magnetized material that are cut into strips. The magnetized material is then sewn onto cape 100 at the appropriate locations. Alternatively, magnets are disposed directly on cape 100 by means of an adhesive to bond the magnet to the cape fabric. In another embodiment, pockets are sewn at the location for magnet placement of a size to snugly receive the magnets in order to maintain the magnets at the designed location.

Figure 2B:
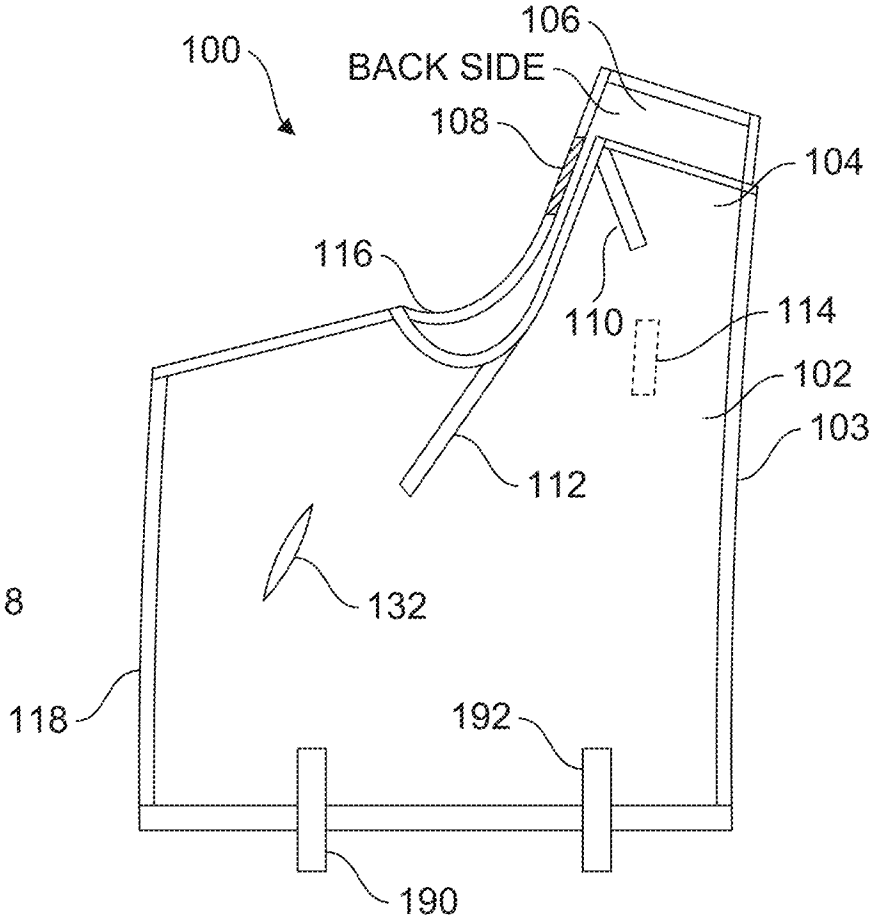
FIG. 2B depicts a side view of a magnetized cape according to an embodiment.
Figure 2A:
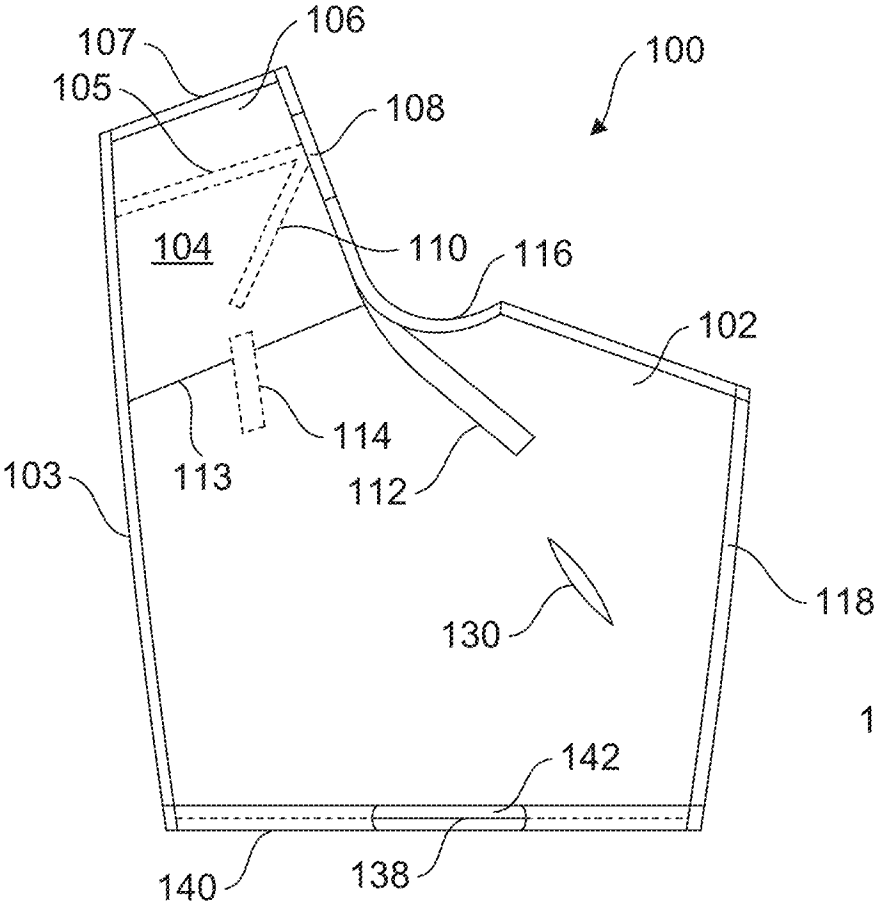
FIG. 2A depicts a side view of a magnetized cape according to an embodiment.

FIG. 2A depicts a side view of a magnetized cape according to an embodiment. In FIG. 2A, a folded side view of cape 100 is shown. Cape body 102 is folded along centerline 118. Right shoulder extended flap 106 is visible as the longer of it and left shoulder flap 104, which in FIG. 2A left shoulder flap 104 and left shoulder edge 105 appear as obscured as they are behind right extended shoulder flap 106. First magnet 110 appears obscured as it on the exterior side of left shoulder flap 104 of cape 100 as placed on the wearer. Second magnet 114 is disposed approximate to exterior side edge 103 of cape body 102. Second magnet 114 is shown as obscured in FIG. 2A as in an embodiment it is on the interior of cape body 102.

When cape 100 is applied to the wearer, left shoulder flap 104 is placed around the wearer's left shoulder and from front to back in a position in which first magnet 110 lays horizontally at the left to center of the middle of the wearer's back. Next, right extended shoulder flap 106 is wrapped around the right shoulder of the wearer from the front to back. As right shoulder edge 107 approaches the center of the wearer's back, the portion of cape body 102 on which second magnet 114 is located arrives in alignment with first magnet 110 at approximately the left center of the wearer's back. First magnet 114 and second magnet 110 are both in a substantially horizontal position at this location, and the two magnets are placed together to secure the cape in this position.

FIG. 2B depicts a side view of a magnetized cape according to an embodiment. FIG. 2B simply provides the opposing view of cape 100 with the exterior of left shoulder flap 104 in the foreground and the cape in a folded position along centerline 118. Because right extended shoulder flap 106 is longer than left shoulder flap 104, the upper part of right extended shoulder flap 106 is visible. In this view of cape 100 in FIG. 2B, first magnet 110 is not obscured as it is on the exterior of left shoulder flap 104. Second magnet 114 remains obscured in this view as it is on the interior of cape body 102 on the side of the right extended shoulder flap 106. Completion of placement of cape 100 on the wearer is provided with the discussion of FIGS. 4A-4C.

Optionally, in an embodiment shown in FIGS. 2A and 2B, slots 130 and 132 are disposed on the front of cape 100 as worn by the wearer. These slots allow the wearer to place his or her hands in the slots while receiving the relevant service. This allows the wearer to sit in a more relaxed position and protect the hands while receiving the relevant service.

FIG. 2A depicts another embodiment in which cape 100 includes one or more drawstring 138 disposed within a hem 140 at the lower edge of cape 100. Drawstring 138 is exposed at the front of cape via hem opening 142 in hem 140. Drawstring 138 permits the wearer to raise the lower edge of cape 100 in the event that the user needs to step away from the chair in which the wearer is receiving service, for example, to use the restroom. This allows the wearer to avoid removing the cape for such purposes. The wearer physically raises lower edge of cape 100 to a desired level and secures the lower edge of cape 100 in place by knotting or tying the exposed section of drawstring to tighten the lower edge of the cape around the waist of the wearer.

In another embodiment, depicted in FIG. 2B, one or more hook and loop material strips 190 and 192 extend from the bottom edge of cape 100. This permits the wearer to roll up the bottom edge of cape 100 to an appropriate height and secure the rolled cape material with self-fastening hook and loop material strips 190 and 192. Drawstring 138 and hook and loop material strips 190, 192 are but two of several optional fastening members through which the wearer may pull up the lower edge of the cape as needed.

Figure 3:
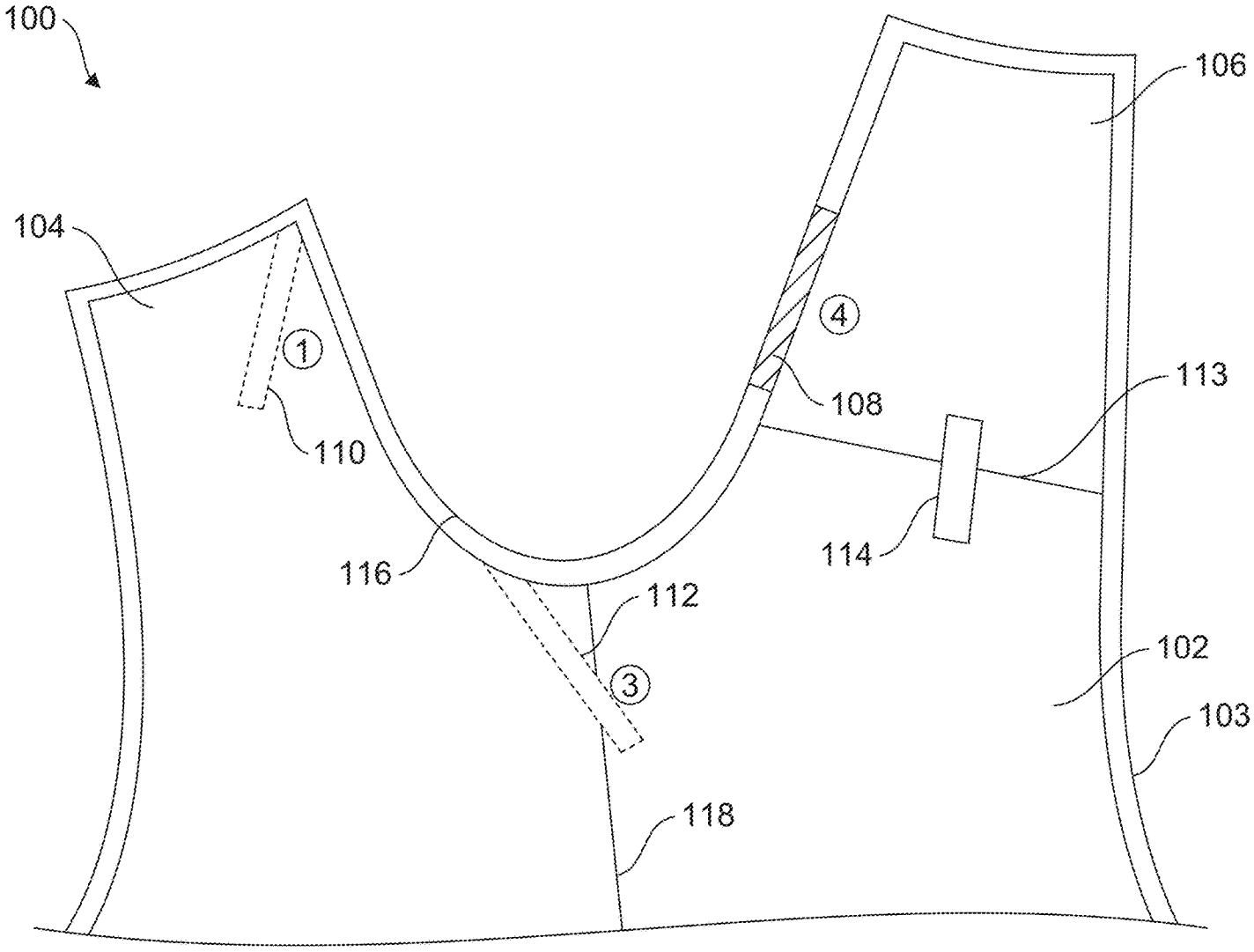
FIG. 3 depicts an interior view of a magnetized cape according to an embodiment.

FIG. 3 depicts an interior view of a magnetized cape according to an embodiment. In FIG. 3, the interior of the upper portion of cape 100 includes cape body 102, collar opening 116, left shoulder flap 104, and right extended shoulder flap 106. First magnets 110, second magnet 114, third magnet 112 and fourth magnet 108 are shown as described. In this view, first magnet 110 and third magnet 112 are shown in dashed lines as obscured as they reside on the exterior side of cape 100. Second magnet 114 and fourth magnet 108 are visible because they reside on the interior side of cape 100. In FIG. 3, points 1, 2, 3 and 4 refer to first magnet 110, second magnet 114, third magnet 112 and fourth magnet 108, respectively. As will be discussed in detail in FIGS. 4A-4C, point 1 connects to point 2, that is first magnet 110 joins second magnet 114, and point 3 connects to point 4, that is third magnet 112 joins fourth magnet 108. Cape 100 is made from various materials such polyester, nylon or a polyester nylon blend.

Figure 4B:
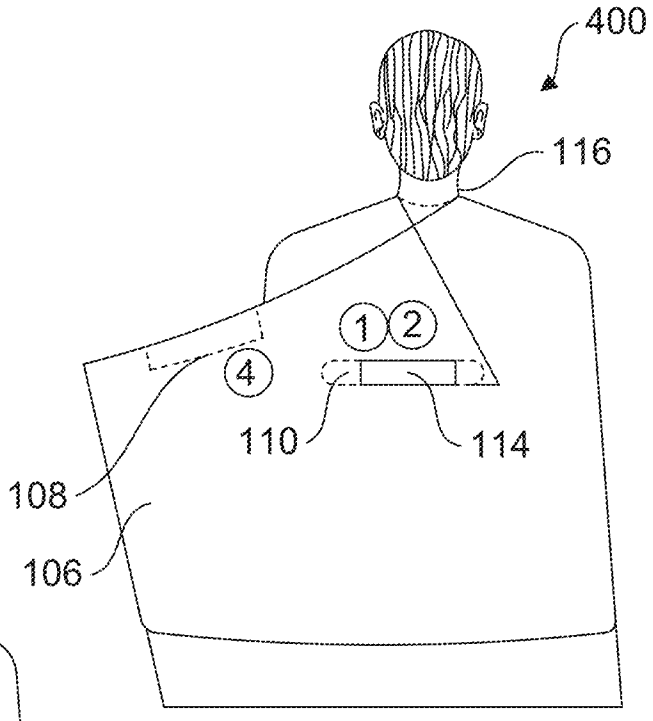
FIG. 4B depicts a perspective view of a magnetized cape applied to a wearer according to an embodiment.
Figure 4C:
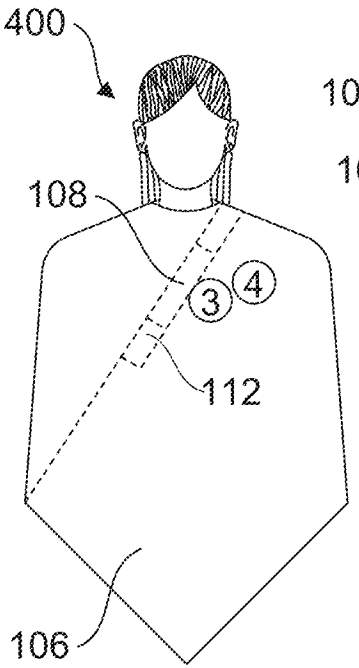
FIG. 4C depicts a perspective view of a magnetized cape applied to a wearer according to an embodiment.
Figure 4A:
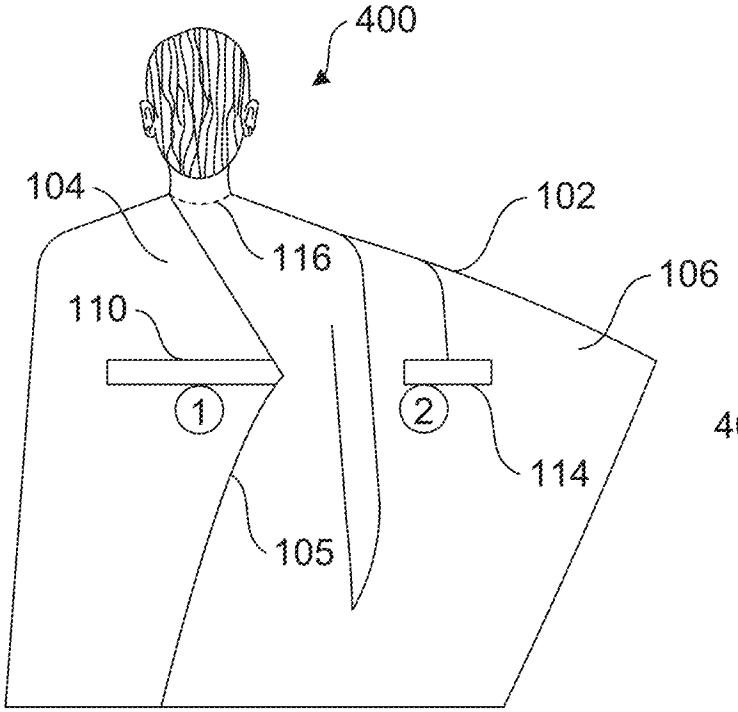
FIG. 4A depicts a perspective view of a magnetized cape applied to a wearer according to an embodiment.

FIGS. 4A-4C depict perspective views of a magnetized cape applied to a wearer according to an embodiment. FIG. 4A shows the first step in placing cape 100 on a wearer according to an embodiment, a magnetized cape applied to a wearer according to an embodiment Cape 100 is applied to a wearer 400, shown from the back in FIGS. 4A and 4B by first situating collar opening 116 (shown in dashed lines as obscured) of cape 100 along the neckline and collar bones of wearer 400. Left shoulder flap 104 is wrapped around wearer 400 from the front to the back around the shoulder area of the wearer. Left flap edge 105 comes to rest at approximately the middle of the back of wearer 400. First magnet 100 assumes a horizontal position, at substantially in the center or left side of the wearer's back.

Point 1 at first magnet 110 will meet point 2 of second magnet once right extended shoulder flap 106 is wrapped, as shown in FIG. 4B.

FIG. 4B shows the second step of placing cape 100 to wearer 100 according to an embodiment. Once left shoulder flap 104 is placed as described, right extended shoulder flap 106 is wrapped around the right shoulder of wearer 400 from front to back, with the edge of collar opening 116 across the neck area of wearer 400. Right extended shoulder flap 106 is passed across the back of the wearer 400 from right to left. This causes second magnet 114 to align with first magnet 110 in a substantially horizontal arrangement. The user placing cape 100 on wearer 400 joins first magnet 110 and second magnet 110 as shown by matching point 1, 2. These magnets are shown as obscured as then are on the interior side of cape 100, in an embodiment. At this juncture, cape 100 is partially secured about the wearer.

FIG. 4C shows the final step in placement of cape 100 on wearer 400, shown from the front of wearer 400. In FIG. 4C, the wrapping of right extended shoulder flap 106 continues around the left shoulder of the wearer, from back to front. As shown in FIG. 4C, once right extended shoulder flap 106 is draped over the wearer's shoulder, it lays in a downward direction. This placement causes third magnet 112, which extends downward from the collar opening 116 that now circles the wearers neck area, to meet fourth magnet 108 disposed on the side edge of right extended shoulder flap 106. Once right extended shoulder flap 106 is so draped in a downward direction, the user applying cape 100 to wearer 400 places third magnet 112 and fourth magnet 108 together at matching point 3,4.

The method depicted and described in connection with FIGS. 4A-4C may be described further as follows. First, a user places a collar opening of a magnetized cape at the torso of a wearer, with the collar opening disposed at a neck area of the wearer. Next, the user wraps a left extended shoulder flap of the magnetized cape around the left shoulder of the wearer towards the back of the wearer. Next, the user drapes a right extended shoulder flap of the magnetized cape around the right shoulder of the wearer towards the back of the wearer. Then, the user aligns a first magnet disposed within the left shoulder flap with a second magnet disposed within the right extended shoulder flap proximate to an outer edge of the magnetized cape. Next, the user joins the first magnet and the second magnet. The user then overlaps the right extended shoulder flap over the left shoulder flap. Then the user wraps an end of the right extended shoulder flap around the left should of the wearer towards the front of the wearer. Next, the user aligns a third magnet disposed on the edge of the right extended shoulder flap with a fourth magnet extending downward at an angle from the collar opening. Finally, the user joins the third magnet with the fourth magnet to secure the magnetic cape to the wearer. "User" refers to the person placing the cape on the wearer.

The placement of cape 100 as described provides efficient and effective securing of a cape on a wearer. The joining points of the four magnets results in relieving pressure around the neck area of the wearer and providing a snug fit of the cape around the entire upper body of the wearer. This provides better coverage of the wearer's skin and garments while the wearer undergoes the relevant treatment, promotes increased wearer comfort, and keeps the cape compactly in place rather than potentially in the way of the treatment provider or others.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solution to problems that are described herein with regard to specific embodiments are not intended to be construed as a critical, required, or essential feature or element of any or all the claims.

ADDITIONAL DISCLOSURE

Clause 1. A cape, comprising:
- a cape body comprising:
  - a left shoulder flap having a left flap edge;
  - a right should flap having a right flap edge;
  - a centerline substantially dividing the cape body into a left body half and a right body half; and
  - an upper material edge forming a neck opening;
- a first magnet disposed in the cape body and extending in a downward, angled position from the intersection of a left body half edge and the left flap edge;
- a second magnet disposed in the right body half proximate to a right body edge;
- a third magnet disposed in the cape body extended in a downward, angled position from the upper material edge forming the neck opening; and
- a fourth magnet disposed in the cape body proximate to a corner formed by the left flap edge and the left body half edge,
- wherein the first magnet connects to the second magnet upon applying the cape to a wearer, and
- wherein the third magnet connects to the fourth magnet upon applying the cape to the wearer.

Clause 2. The cape of any proceeding or preceding clause, wherein the cape body is made of polyester.

Clause 3. The cape of any proceeding or preceding clause, wherein the first magnet, the second magnet, the third magnet and the fourth magnet are magnetized fabric.

Clause 4. The cape of any proceeding or preceding clause, wherein the first magnet, the second magnet, the third magnet and the fourth magnet are bar magnets.

Clause 5. The cape of any proceeding or preceding clause, wherein the first magnet, the second magnet, the third magnet and the fourth magnet are sewn into the cape body.

Clause 6. The cape of any proceeding or preceding clause, wherein the first magnet, the second magnet, the third magnet and the fourth magnet are attached to the cape body with an adhesive.

Clause 7. The cape of any proceeding or preceding clause, wherein the first magnet, the second magnet, the third magnet and the fourth magnet are attached to the cape body with an adhesive.

Clause 8. The cape of any proceeding or preceding clause, wherein the cape body is made of nylon.

Clause 9. The cape of any preceding clause, wherein the cape body is made of a polyester nylon blend.

Clause 10. The cape of any preceding clause, further comprising a drawstring disposed in a lower hem of the cape for maintaining a bottom edge of the cape in a raised position.

Clause 11. The cape of any preceding clause, further comprising at least one hook and loop strip disposed at a bottom edge of the cape for maintaining the bottom edge of the cape in a raised position.

Clause 12. A method of applying a magnetized cape to a wearer, the method comprising the steps of:

placing a collar opening of a magnetized cape at the torso of a wearer, with the collar opening disposed at a neck area of the wearer;

wrapping a left extended shoulder flap of the magnetized cape around the left shoulder of the wearer towards the back of the wearer;

draping a right extended shoulder flap of the magnetized cape around the right shoulder of the wearer towards the back of the wearer;

aligning a first magnet disposed within the left shoulder flap with a second magnet disposed within the right extended shoulder flap proximate to an outer edge of the magnetized cape;

joining the first magnet and the second magnet;

overlapping the right extended shoulder flap over the left shoulder flap;

wrapping an end of the right extended shoulder flap around the left should of the wearer towards the front of the wearer;

aligning a third magnet disposed on the edge of the right extended shoulder flap with a fourth magnet extending downward at an angle from the collar opening; and joining the third magnet with the fourth magnet to secure the magnetic cape to the wearer.

I claim:

1. A cape, comprising:

a cape body comprising:

a left shoulder flap having a left flap edge;

a right shoulder flap having a right flap edge;

a centerline substantially dividing the cape body into a left body half and a right body half; and an upper material edge forming a neck opening;

a first magnet disposed in the cape body and extending in a downward, angled position from the intersection of a left body half edge and the left flap edge;

a second magnet disposed in the right body half proximate to a right body edge;

a third magnet disposed in the cape body extended in a downward, angled position from the upper material edge forming the neck opening; and a fourth magnet disposed in the cape body proximate to a corner formed by the left flap edge and the left body half edge, wherein the first magnet connects to the second magnet upon applying the cape to a wearer, and wherein the third magnet connects to the fourth magnet upon applying the cape to the wearer.

2. The cape of claim 1, wherein the cape body is made of polyester.

3. The cape body of claim 1, wherein the first magnet, the second magnet, the third magnet and the fourth magnet are magnetized fabric.

4. The cape body of claim 1, wherein the first magnet, the second magnet, the third magnet and the fourth magnet are bar magnets.

5. The cape body of claim 3, wherein the first magnet, the second magnet, the third magnet and the fourth magnet are sewn into the cape body.

6. The cape body of claim 3, wherein the first magnet, the second magnet, the third magnet and the fourth magnet are attached to the cape body with an adhesive.

7. The cape body of claim 4, wherein the first magnet, the second magnet, the third magnet and the fourth magnet are attached to the cape body with an adhesive.

8. The cape of claim 1, wherein the cape body is made of nylon.

9. The cape of claim 1, wherein the cape body is made of a polyester nylon blend.

10. The cape of claim 1, further comprising a drawstring disposed in a lower hem of the cape for maintaining a bottom edge of the cape in a raised position.

11. The cape of claim 1, further comprising at least one hook and loop strip disposed at a bottom edge of the cape for maintaining the bottom edge of the cape in a raised position.

12. A method of applying a magnetized cape to a wearer, the method comprising the steps of:

placing a collar opening of a magnetized cape at the torso of a wearer, with the collar opening disposed at a neck area of the wearer;

wrapping a left extended shoulder flap of the magnetized cape around the left shoulder of the wearer towards the back of the wearer;

draping a right extended shoulder flap of the magnetized cape around the right shoulder of the wearer towards the back of the wearer;

aligning a first magnet disposed within the left shoulder flap with a second magnet disposed within the right extended shoulder flap proximate to an outer edge of the magnetized cape;

joining the first magnet and the second magnet;

overlapping the right extended shoulder flap over the left shoulder flap;

wrapping an end of the right extended shoulder flap around the left should of the wearer towards the front of the wearer;

aligning a third magnet disposed on the edge of the right extended shoulder flap with a fourth magnet extending downward at an angle from the collar opening; and joining the third magnet with the fourth magnet to secure the magnetic cape to the wearer.

* * * * *